United States Patent [19]

Laauwe

[11] 4,157,789

[45] Jun. 12, 1979

[54] RIGHT-ANGLE SPRAY NOZZLE

[76] Inventor: Robert H. Laauwe, 237 Green Ridge Rd., Franklin Lakes, N.J. 07417

[21] Appl. No.: 850,197

[22] Filed: Nov. 10, 1977

[51] Int. Cl.[2] ..... B65D 1/32; B05B 1/34

[52] U.S. Cl. ..... 239/327; 222/632; 222/211; 239/404; 239/492

[58] Field of Search ..... 222/193, 206, 211, 212, 222/553; 239/327, 328, 404, 491–494, 496

[56] References Cited

U.S. PATENT DOCUMENTS

| | | | |
|---|---|---|---|
| 3,295,730 | 1/1967 | Moran | 222/553 |
| 4,020,979 | 5/1977 | Shay et al. | 239/492 X |

FOREIGN PATENT DOCUMENTS

| | | | |
|---|---|---|---|
| 7705747 | 12/1977 | Netherlands | 239/327 |

*Primary Examiner*—Robert B. Reeves
*Assistant Examiner*—Andres Kashnikow
*Attorney, Agent, or Firm*—Kenyon & Kenyon, Reilly, Carr & Chapin

[57] ABSTRACT

A right-angle spray nozzle, intended for a squeeze bottle containing a liquid product with air above the product, provides for forming an aerosol spray from an orifice supplied by a swirl chamber having two tangential injection inlets separately fed by air and product respectively when the bottle is squeezed to pressurize the air above the product in the bottle. The spray is ejected in the form of an aerosol at right angles to the axis of the bottle.

7 Claims, 12 Drawing Figures

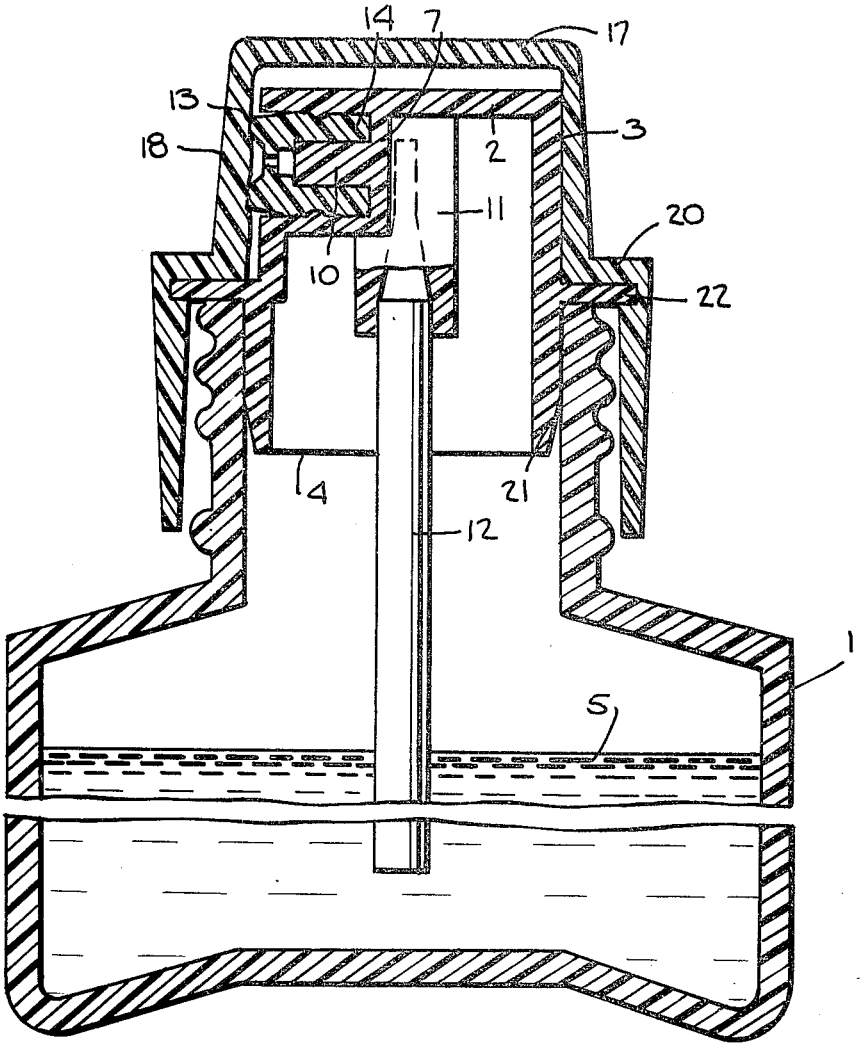
Fig.8.
Fig.12.
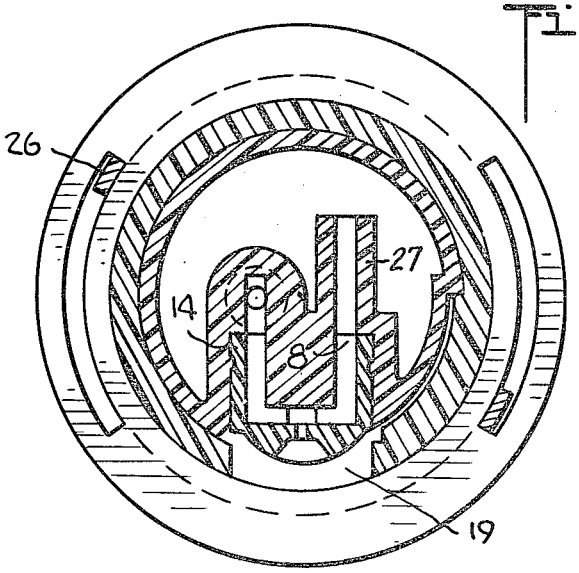

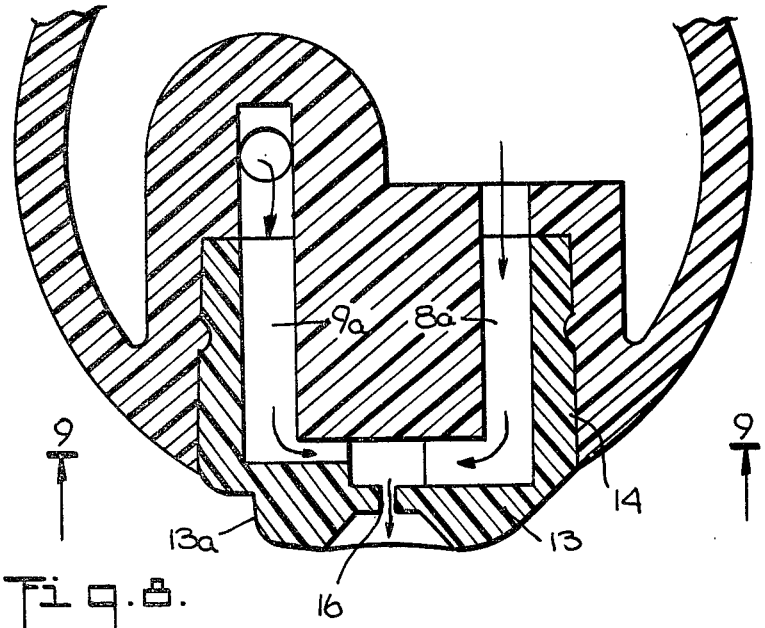
Fig. 8.
Fig. 9.
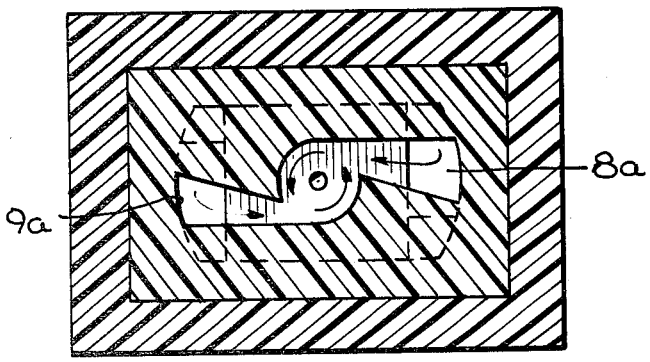
Fig. 10.
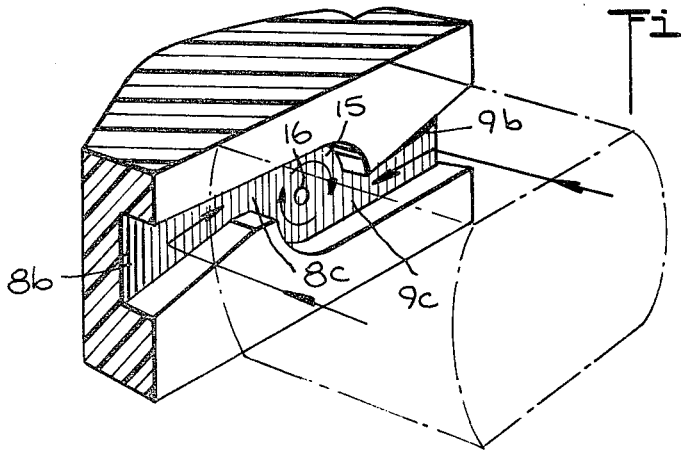

RIGHT-ANGLE SPRAY NOZZLE

BACKGROUND OF THE INVENTION

The Laauwe application Ser. No. 789,189, filed Apr. 20, 1977, now U.S. Pat. No. 4,122,979, issued Oct. 31, 1978, discloses a concept that is new to the squeeze bottle and aerosol arts.

Briefly stated, that concept is that a squeeze bottle containing a liquid product, such as an anti-perspirant and the like, has a dispensing nozzle internally forming a swirl chamber having opposed orifices each having its own inlet. One inlet is connected with a dip tube that dips into the liquid when the bottle is upright, and the other inlet connects with an air space above the liquid when the bottle is upright. When the bottle is squeezed, the swirl chamber receives opposed jets of the liquid and air, producing an atomized spray.

Surprisingly, that concept permits a squeeze bottle via only inherently low-pressure air and product provided by squeezing of the bottle, to eject as good, if not better, an aerosol as can be provided by any known aerosol or pump-type spray dispensing package, either of which via liquified gas propellant or a finger-powered piston area of minute dimensions, provide much higher ejection pressures. An obvious advantage is that a squeeze bottle package is much less expensive to produce than an aerosol package with its rigid container, liquified gas content and dispensing valve; or the pump-type package with its complicated and, therefore, expensive pump.

In his application Laauwe discloses a nozzle construction by which the aerosol is discharged axially with respect to the bottle axis. Many liquid products used in aerosol form require the aerosol spray to be discharged other than in a vertical direction. An anti-perspirant is an example.

Therefore, in his application Laauwe discloses the use of a throttling valve for the air intake of the nozzle with a normal dip tube dipping into the liquid product and providing the liquid spray, keeping in mind that the air and liquid are fed to the swirl chamber each individually via the swirl chamber's interspaced and individual injection orifices. This valve permits the squeeze bottle to be used other than upright and even when upside down, because when upside down, it is the dip tube feeding the air while what was formerly the air feed becomes the liquid feed, the throttling valve being gravity actuated to at that time exert a throttle action preventing overfeeding of the liquid relative to the air. Even with this valve arrangement the Laauwe squeeze bottle package is the least expensive of any of the packages capable of producing an aerosol with the characteristics the public has learned to demand via the aerosol package or so-called aerosol can which is being phased out to a substantial extent because of its alleged polluting or flammable spray characteristics.

It has been found desirable to provide the Laauwe squeeze bottle with a right-angle spray nozzle by which is meant a nozzle that can eject the aerosol spray, characteristic of the Laauwe concept, transversely with respect to the axis of the bottle, a right angle ejection being presently preferred because it appears to be most acceptable to the public used to the right-angle spray from the old familiar aerosol can. Such a nozzle would eliminate the need for a gravity-operated valve or other expedients when an aerosol spray in a generally horizontal direction is desirable, because the bottle would not have to be tilted to any great degree for that purpose.

The prior art does disclose examples of nozzles providing for a squeeze bottle right-angle spray, but these do not appear to be adaptable to the Laauwe concept while adhering to the demands for simplicity, low cost and reliability required in the case of squeeze bottles intended for production by the millions.

For example, the old 1929 Leong U.S. Pat. No. 1,716,525 discloses a relatively simple, although valved, right angle spray nozzle for a squeeze bottle. However, this operates on the old principle of discharging the air pressurized by bottle squeezing, at right angles over the stream of the liquid ejected by the same pressurization, relying on shear exerted on the liquid by the resulting air jet to produce an atomized spray. Such a spray does not approach the extremely small particle size characteristic of an aerosol which the public has learned to demand.

A more recent example is the Shay et al. U.S. Pat. No. 4,020,979, May 3, 1977, showing a squeeze bottle with right-angle nozzle used in conjunction with a swirl chamber for the discharge orifice. However, here again the principle of atomization is the same as that of the old Leong patent, the ejection of air in swirl form right angularly across the liquid feed allegedly providing increased shear and, therefore, a fine mist spray. Using this old atomization principle, the right angle nozzle designing of a commercially producible nozzle is not unduly complicated.

The object of the present invention is to provide a right angle nozzle for a squeeze bottle and which has the advantages of the previously described Laauwe concept and, in addition, all of the other requirements for a squeeze bottle right angle nozzle that must be produced in quantities of millions in a commercially satisfactory manner.

SUMMARY OF THE INVENTION

With the foregoing in mind, the present invention is a right angle nozzle particularly intended for a squeeze bottle containing a liquid product and air above the product when pressurized by squeezing the bottle. However, it could be used for any container containing a liquid product and pressurized gas or vapor above the product.

This new nozzle comprises a hollow body having a closed top from which a skirt depends with an open bottom for exposure to the air which is above the liquid product in a squeeze bottle, this air being pressurized by bottle squeezing. This skirt is formed with a transversely inwardly extending cavity with a back wall through which two mutually interspaced holes are formed. A post extends forwardly from this back wall between the holes with a space surrounding the post within the cavity side wall. This post is imperforate and it may be made solid. Excepting for the two holes, this cavity is closed off from the inside of the hollow body. One of the holes, on the inside of the body, is provided with a connection for the usual dip tube which dips into the liquid in the bottle.

A hollow insert has a front wall and a backwardly extending skirt adapted to be press-fitted into the space formed around the post by the side wall of the cavity. To form the swirl chamber, the back of this front wall, by which is meant the inside surface of the insert's front wall, and the forward end of the post cooperate to form the swirl chamber with the two tangential inlets required to practice the Laauwe concept and, of course, the discharge orifice formed through the insert's front wall for the discharge of the aerosol spray.

The hole in the back wall of the cavity which is not provided with the dip tube connection, opens into the inside of the previously mentioned skirt and is exposed to the pressurized air in the bottle when the squeeze bottle is squeezed, so that one of those holes receives the pressurized air and the other receives the liquid product. To get these two fluid components separately and individually to the two injection inlets of the swirl chamber in front of the post, the skirt of the insert and the post are made to cooperate to form the two passages required.

To provide such cooperation with only the two parts, the body and the insert, the body's cavity and the insert are both made with rectangular cross sections and the insert's skirt has two mutually opposite sides, the top and bottom sides, for example, closing or blocking or filling the space between the interspaced two holes in the back wall of the cavity, above and below the post for example. The insert's skirt has its two other mutually opposite sides incompletely closing that space which, of course, extends from the holes to the inlets. The arrangement is such that the necessary individual and segregated passages are thus very simply provided.

More specifically, with upright orientation of the nozzle and bottle the rectangular parts are oblong and horizontally arranged and the holes on either side of the post are horizontally interspaced. The flat top and bottom of the skirt is made thick enough to completely close the space above and below the post, thus cutting off communication between the two holes. Ths two sides of the rectangular skirt of the insert have outside surfaces which press against the inside surfaces of the corresponding sides of the cavity, but these sides are made thin enough to leave spaces between them and the sides of the rectangular post, thus forming passages each leading from one of the holes in the cavity's back wall to one of the swirl chamber's injection orifices or inlets, thus providing the two passages for individually feeding the air and liquid separately from each other to the two inlets of the swirl chamber.

Both the body and its insert are designed to permit their production by plastic injection-molding machines; the parts introduce no complications in connection with making the necessary tools or dies for the machines.

For shipment and merchandising, there must be some provision against loss of a liquid product packaged in the squeeze bottle. In the case of the construction of the package disclosed by the previously-mentioned Laauwe application, a screw cap was provided which covered the nozzle and was screwed on and off the external threads of the necks of many squeeze bottles commercially available today. It is desirable to provide a closure permanently connected to the squeeze bottle neck.

Therefore, in the case of the nozzle of the present invention, the previously described skirt and the top from which it depends are made of circular shape, the skirt being cylindrical and in its presently designed commercial form being designed for a press fit within the squeeze bottle mouth. The insert with its discharge orifice is preferably designed to project slightly radially beyond the cylindrical skirt so that it, in effect, forms a valve seat. A cap which seats over the nozzle and is rotatively secured to the nozzle forms a cylindrical sleeve which rotatively encircles the nozzle body skirt and this rotative sleeve is formed with a radial opening. When this sleeve, formed by the cap, is turned or rotated to one rotative position, the inside of the sleeve rides over the projecting insert front and closes off the entire insert, the sleeve, in effect, forming a rotative valve. If the insert's front does not project from the body's skirt, the mouth of the cavity is closed by the sleeve. When not in a closed rotative position with the respect to the sleeve, the radial opening through the sleeve registers with the cavity mouth and insert so that the latter's discharge orifice is open.

Preferably the sleeve is provided on its inside cylindrical surface with a slightly inwardly raised pad increasing the security of the sealing action when the sleeve is rotated to its closed position, the pad then seating on the insert's front when it projects as described. The cap itself is a plastic injection-molding and it, therefore, has some degree of elastic deformability so that the cylindrical skirt can radially stretch a little and elastically hold the pad against the insert when forming the valve seat. The strain on the cap skirt might cause the cap to tilt somewhat, but the circular skirt of the valve body can be externally provided with axially extending ribs interspaced around its periphery, it having been found that such ribs prevent cap-tilting when it has been experienced.

The insert can be simply press-fitted into the cavity formed in the skirt of the valve body and preferably the swirl chamber including its tangential inlets is formed in the inside of the front end of the insert with the cavity's forwardly projecting post having a plain flat surface providing one wall of the swirl chamber and inlets, the other wall being, of course, provided by the insert. This permits the use of different inserts designed for liquid products of differing viscosity or flow characteristics, and being made of plastic the inserts can be differently color coded for the different liquid products so as to avoid possible confusion as to the use of the inserts.

The skirt of the nozzle above its portion designed for insertion in the squeeze bottle mouth and below its portion forming the cavity, is provided with an outwardly projecting annular flange and the cap is provided with a corresponding inwardly extending annular groove so that the cap can be simply pressed onto the nozzle body with the flange and groove intersnapping, thus permanently attaching the cap to the nozzle body.

To limit rotation of the cap to its two rotative positions, the outside of the valve body's skirt is formed with a depressed cylindrical segment in which the valve pad of the rotative cap's sleeve rides, the rotative limits being fixed by the extent of the depressed cylindrical segment of the skirt in which the pad rides. As an additional precaution, the cap's sleeve which is rotatively connected to the valve body via the latter's flange and the sleeve's groove, can be made in the form of an outwardly projecting shoulder in which arcuate slots are formed, the valve body's flange then having upwardly extending lugs which project into these arcuate grooves, the extents of the latter limiting the cap's rotation.

BRIEF DESCRIPTION OF THE DRAWINGS

The accompanying drawings illustrate the new nozzle of this invention as it has been designed for commercial production, the various figures being as follows:

FIG. 3 is a vertical section of the bottle and cap with the nozzle itself shown in elevation with the insert and its discharge orifice facing the viewer;

FIG. 5 is like FIG. 4 but shows the nozzle closed, the cap being turned to its sealing position;

FIG. 9 is a cross section taken on the line IX—IX in FIG. 8;

FIG. 10 in perspective schematically shows the back of the front wall of the insert with the cavity's post shown in phantom, all for the purpose of showing how the two components flowing on either side of the cavity's post enter and swirl in the swirl chamber formed on the back of the front wall of the insert;

FIG. 12 is a cross section similar to FIG. 6 but showing a modification.

DETAILED DESCRIPTION OF THE INVENTION

Figure 1:
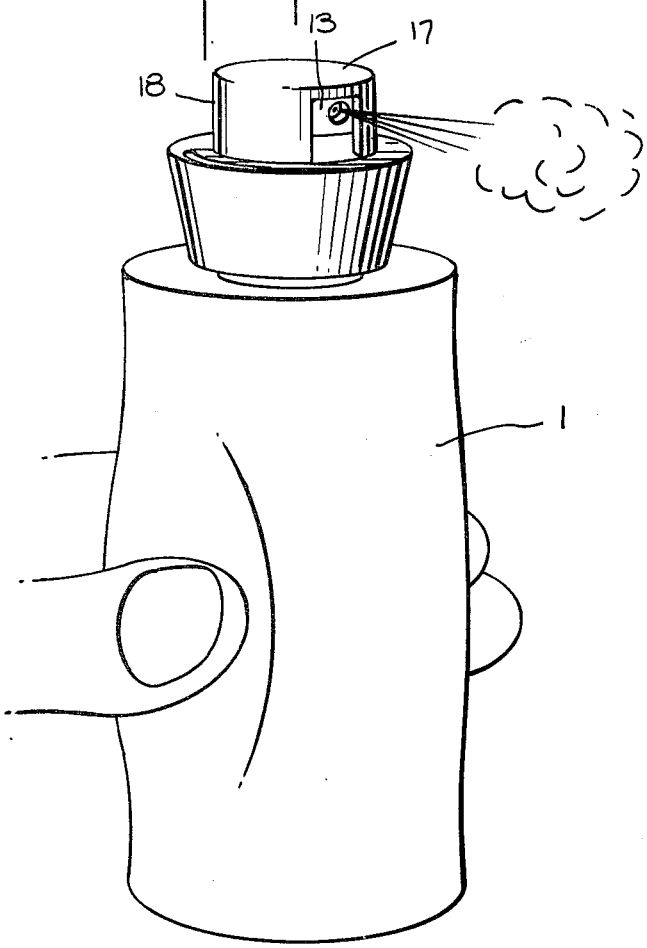
FIG. 1 is a perspective view showing the squeeze bottle with its nozzle open, and being squeezed to eject the aerosol spray.
Figure 2:
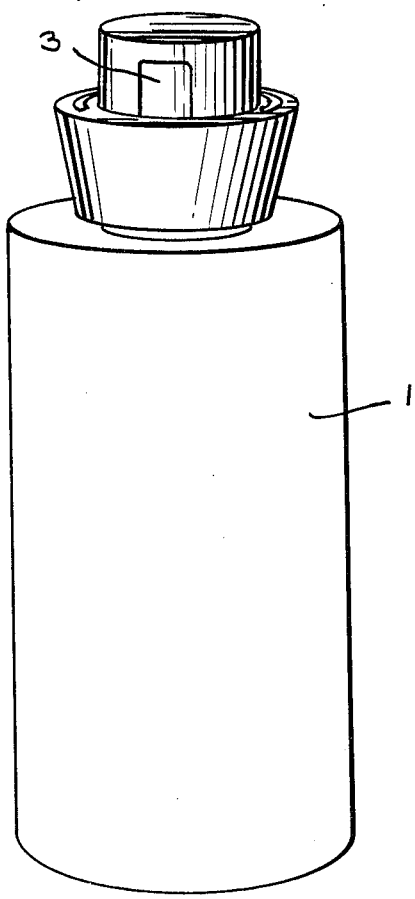
FIG. 2, also a perspective view, shows the bottle with the nozzle closed as the bottle would appear during shipment and merchandising and, of course, when the bottle is closed by the ultimate user.
Figure 4:
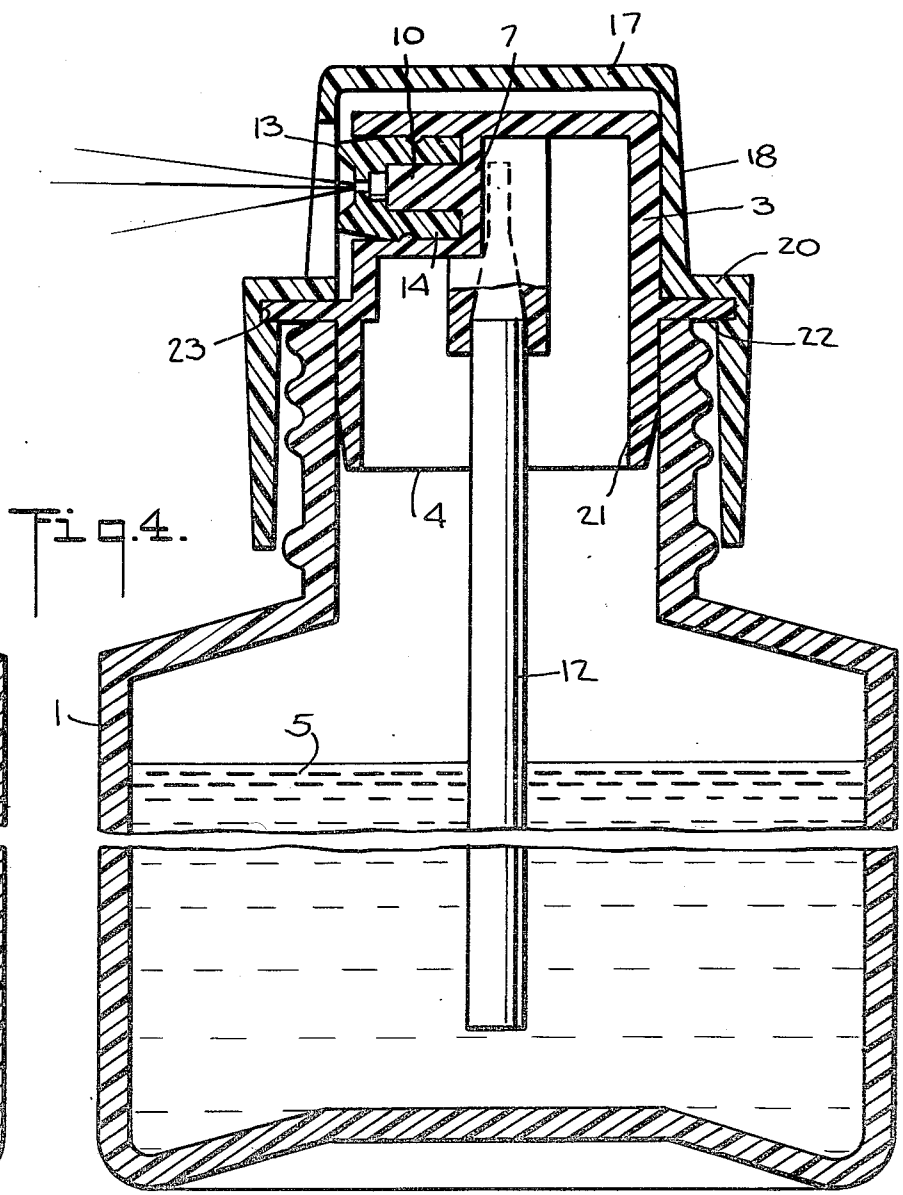
FIG. 4 is a vertical section taken completely through all of the parts excepting for the dip tube and a portion of its connection, the insert facing in the left-hand direction in this instance, the cap being turned to its open position.
Figure 8:
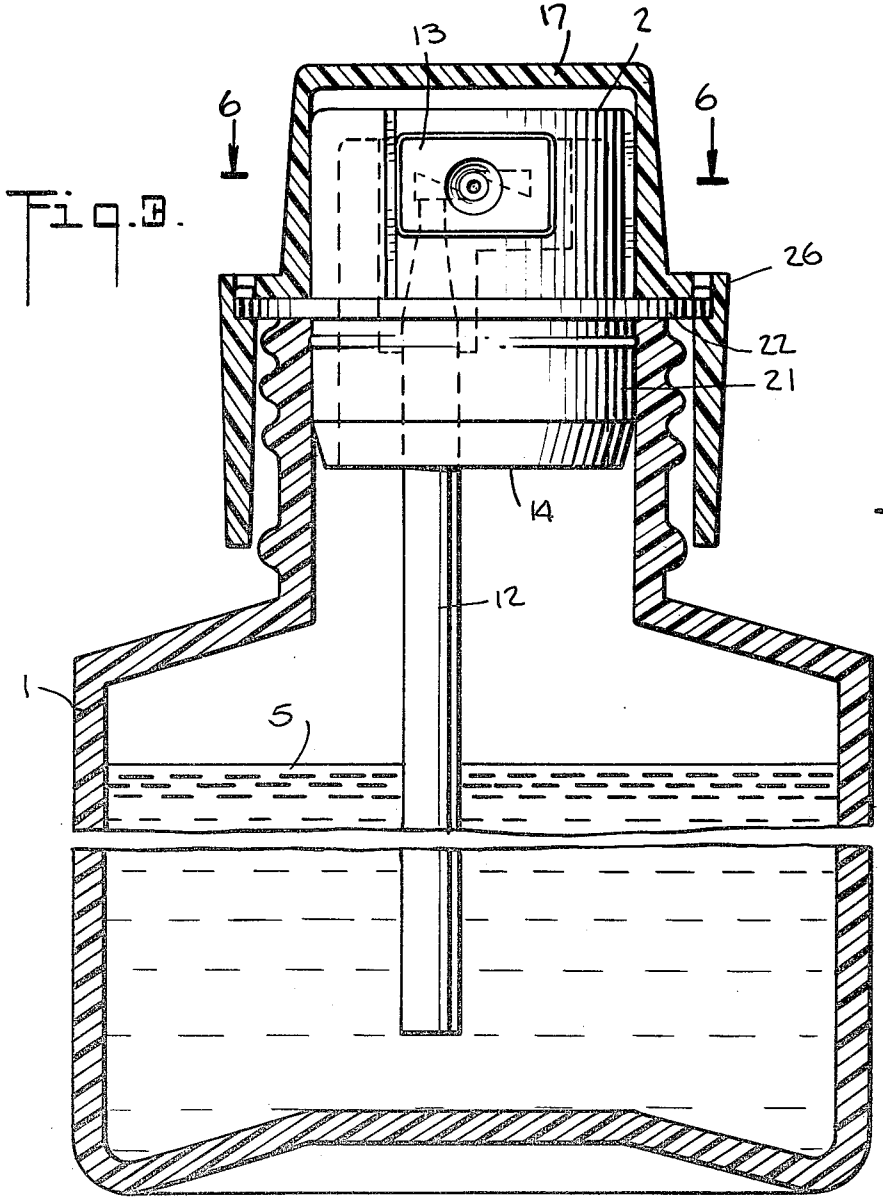
FIG. 8 is a partial cross section and shows the flow paths of the liquid product and air as they separately travel to and through the swirl chamber.
Figure 11:
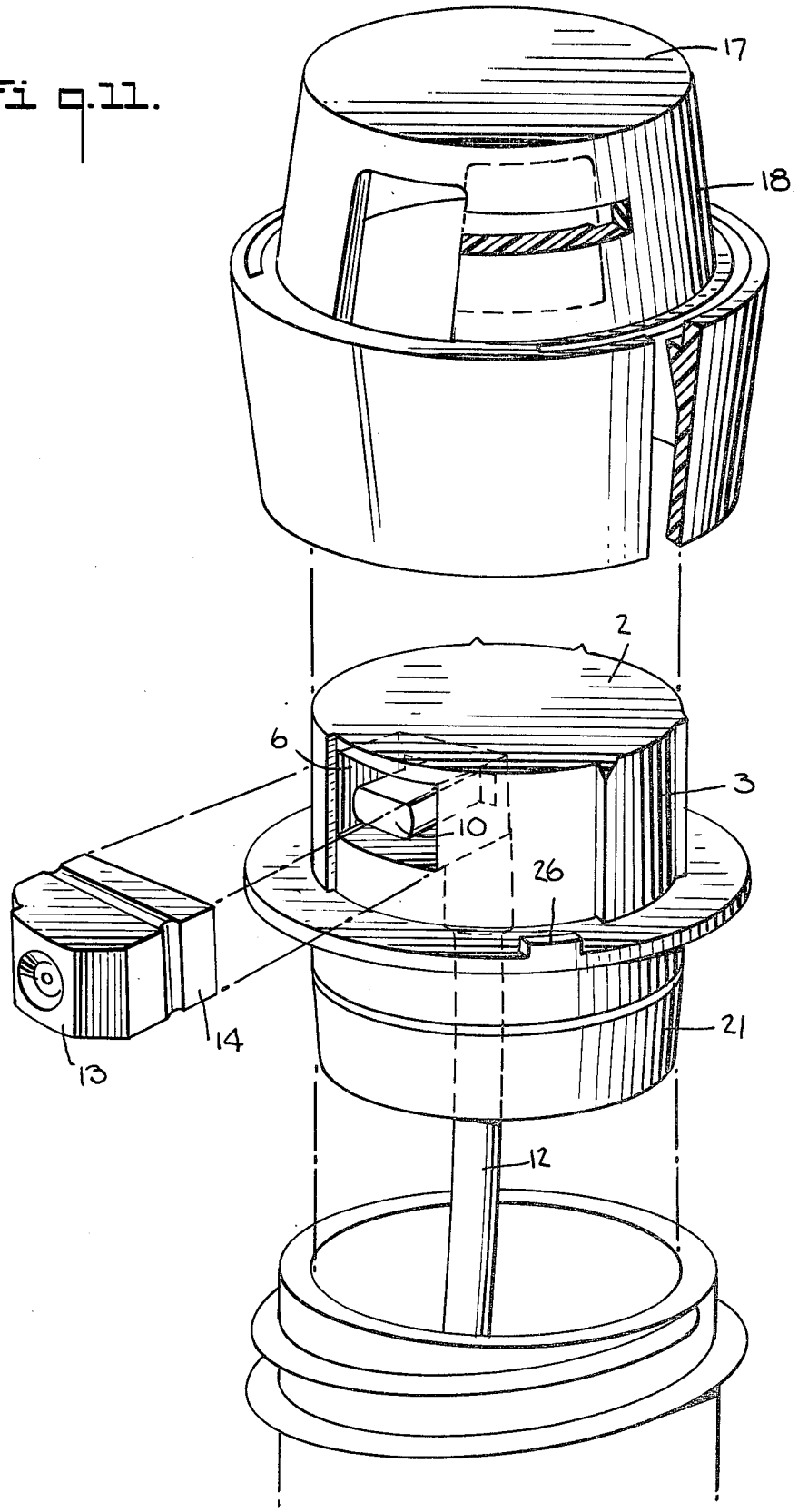
FIG. 11 is an exploded view showing the the three components of the new valve and its sealing cap.

The attractive appearance the new nozzle and its cap provides when on a squeeze bottle is shown by FIGS. 1 and 2. In FIG. 1 the squeeze bottle 1 containing a liquid product, such as an anti-perspirant, with air above the product, as illustrated by FIGS. 3 and 4, is being squeezed with the aerosol being ejected, the cap being turned to its open position. FIG. 2 shows the cap turned to its closed position so that the insert is concealed with its discharge orifice sealed. For high visibility, clearly showing that the cap is in its open position with the bottle ready for use, the insert can be contrastingly colored with respect to the color of the cap, and during the manufacture of the package the insert color may serve as a code to identify the dimensions of the swirl chamber and its inlets and the orifice, these dimensions varying as required for the nozzle to handle liquid products of differing viscosities or other characteristics.

The details of the nozzle and cap constructions are shown by the balance of the figures.

The hollow body of the nozzle has a flat top 2 which is closed and in the form of a circular disk, the skirt 3 which depends from this top being cylindrical and having the open bottom 4 exposed to the air above the liquid 5 in the squeeze bottle 1. This skirt 3 has the right angular or transversely inwardly extending cavity 6 having the back wall 7 through which the two holes 8 and 9 are formed and from which the solid or imperforate post 10 extends forwardly from between the holes with the space surrounding the post. Excepting for the two holes 8 and 9, the cavity is closed off from the inside of the hollow body having the top 2 and skirt 3, the hole 9 opening into a tube 11 depending from the inside surface of the top 2, the inside of this tube 11 being dimensioned to receive the dip tube 12 which dips into the liquid product 5.

All of the above described parts of the hollow nozzle body are integral, the body being a plastic injection molding.

As is illustrated by the drawings, the cavity 6 is rectangular in cross section, being in the form of an oblong which is oriented horizontally, the holes 8 and 9 in the back wall of the cavity being horizontally positioned on the opposite sides of the post 10.

The hollow insert is also a plastic injection molding, its front wall 13 having the backwardly extending skirt 14 of rectangular contour and dimensioned to be press-fitted into the cavity 6 with the post 10 on the rectangular interior of the insert. The top and bottom walls of the insert are made thick enough to completely close off the space above and below the top and bottom of the post 10 so that the holes 8 and 9 are segregated from each other. The side walls of the insert have outsides press-fitting the mating surfaces of the cavity, but the insert's side walls are made thin enough to internally leave spaces between them and the corresponding side walls of the post 10. The result is that two passages 8*a* and 9*a* are formed leading forwardly from the holes 8 and 9 respectively. Because of the rectangular shapes of the cavity and insert, the insert cannot rotate relative to the nozzle body. Because the insert and cavity are symmetrical parts and because of their oblong shapes, the forwardly leading passageways are positively formed without using orientation care in the press-fitting of the insert into the cavity. The top and bottom of the insert are the same. Inaccurate insert installation is a substantial impossibility.

Furthermore, the swirl chamber in this form of the nozzle, is formed in the back wall of the insert. This is illustrated particularly well by FIGS. 9 and 10 where the two long inlets 8*b* and 9*b* are most clearly shown, these leading to and/or forming the tangential inlets or injection orifices 8*c* and 9*c* for the swirl chamber 15 from the axis of which the discharge or spray orifice 16 is formed to extend forwardly through the front wall 13 of the insert. When the insert is positioned in the cavity of the nozzle body, the outer ends of the inlets or passages 8*b* and 9*b* register with the passages 8*a* and 9*a* cooperatively formed by the insert and nozzle body cavity. The outer ends of the two inlets 8*c* and 9*c* are closed by the cavity side walls and from there to their inner ends and the swirl chamber itself all are closed on the insides or back sides by the flat front end 10 of the solid post 6, of course leaving the extreme ends of the inlet 8*b* and 9*b* open to the two passages feeding from the holes 8 and 9.

The insert is, of course, a plastic injection molding and can have any color desired, preferably a color contrasting with the injection molded nozzle body.

In the foregoing way the previously referred to Laauwe concept is obtained in the case of a right-angle spray nozzle. The passages for the air and liquid, pressurized when the bottle is squeezed, can be provided with precision as to lengths and cross sections and shapes, by using only the two injection-molded parts. It is substantially impossible to assemble the two parts inaccurately.

As previously mentioned, the front wall 13 of the insert projects radially at least slightly beyond the skirt 3 of the nozzle body, this front wall 13 being formed with a projection 13a which surrounds the insert's spray orifice 16.

Figure 6:
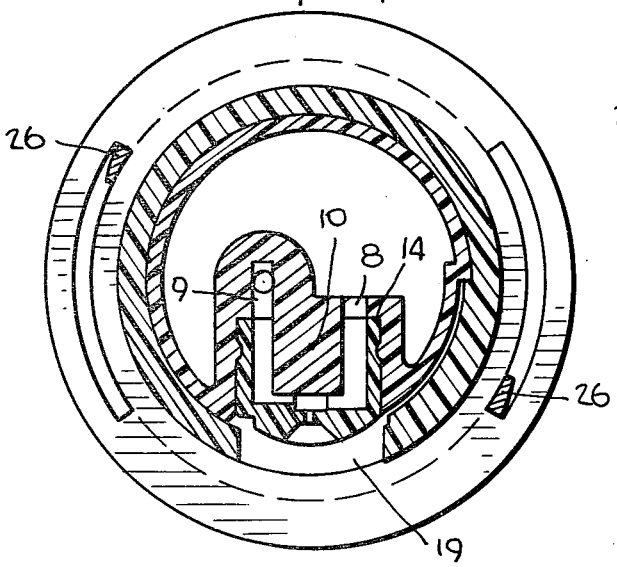
FIG. 6 is a cross section taken on the line VI—VI in FIG. 3 and showing the open position.
Figure 7:
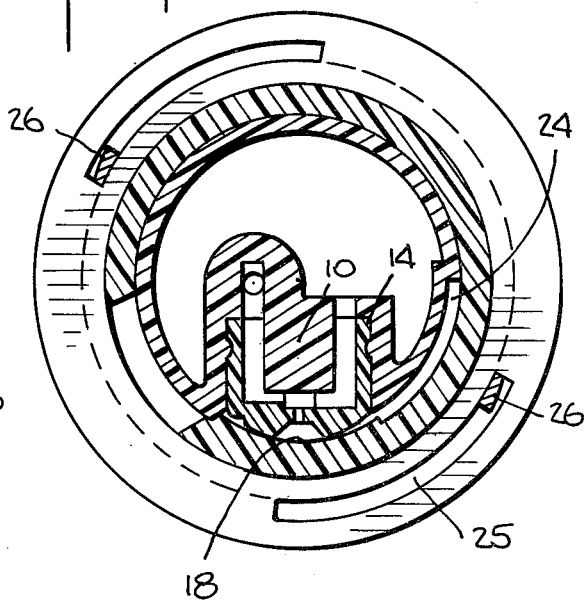
FIG. 7 is the same as FIG. 6 but shows the closed position.

The cap for the nozzle has a flat closed circular top 17 from which the cylindrical sleeve 18 depends. This sleeve is externally tapered slightly upwardly for appearance but its inside surface is cylindrical so that it can rotate on the cylindrical skirt of the nozzle body. This inside has the valve head or pad 18 which rides over and presses on the outside face of the nozzle's insert when the cap is turned to the position shown by FIG. 7, the cap being turned reversely as shown by FIG. 6 so that its opening 19 registers with the cavity and insert, when operation of the squeeze bottle is desired. A plastic can be used having some elastic deformability so the sealing action can be made effective. This sealing pad could be a separate part having greater elastic deformability than the plastic in which the cap is made.

To retain the cap on the nozzle body, the sleeve of the cap is formed with a shoulder 20 from the outer periphery of which the sleeve continues on downwardly so as to cover the outside of the neck of the squeeze bottle as shown by FIGS. 3 and 4 in particular. The valve body also has its skirt continued downwardly as at 21 to form a press-fit with the inside of the bottle neck, the degree of insertion being limited by a flange 22 which extends radially from the nozzle body's skirt, this flange being radially dimensioned to extend radially beyond the bottle's mouth or neck and the depending part of the sleeve of the cap having an annular groove 23 into which the outer periphery of the flange 22 snaps when the cap is pushed down over the valve body. In this way the cap is retained on the valve body in a rotative fashion.

To limit rotation of the cap to its open and closed positions, the outer periphery of the cylindrical valve body skirt is formed with a circumferentially extending recess 24 in which the pad 18 rides with its ends butting the ends of this recess when at either of the extremes of its rotative positions establishing the opening and closed positions. In addition, the shoulder 20 of the cap can be provided with arcuate slots 25 with the flange 22 of the valve body then having upwardly projecting lugs 26 which project upwardly in these arcuate slots, thus providing further assurance against excessive rotation of the cap.

The squeeze bottle using this new nozzle assembly can be operated not only vertically but tilted forwardly in the direction the nozzle points for discharge, the degree of tilt permissible being limited to that causing the liquid product to enter the air hole 8 of the nozzle's insert. Further tilting is possible if the hole 8 is provided with an extension 27 as shown in FIG. 12.

What is claimed is:

1. A nozzle for a container containing a liquid product and pressurized gas or vapor above the product, said nozzle comprising a hollow body having a closed top from which a skirt depends with an open bottom for exposure to said gas or vapor, said skirt being formed with a transversely inwardly extending cavity with a back wall through which two mutually interspaced holes are formed and a post extending forwardly from the back wall between the holes with a space surrounding the post, and means on the inside of said skirt for connecting one of said holes with a dip tube for the liquid; and a hollow insert having a front wall and a backwardly extending skirt adapted to be press-fitted into said space, the back of said front wall and the forward end of said post cooperatively forming a swirl chamber having two tangential inlets and a discharge orifice formed through the insert's front wall, the insert's said skirt and said post forming passages respectively connecting the swirl chamber's said inlets each individually with one of said holes so that said gas or vapor and said liquid are separately injected into said swirl chamber.

2. The nozzle of claim 1 in which said cavity and the insert's said skirt are rectangular in cross section and said skirt has two mutually opposite sides closing said space between said holes and two mutually opposite sides incompletely closing said space extending from said holes to said inlets and so as to form said passages.

3. The nozzle of claim 1 in which said means is a tube depending from the bottom of said body's closed top past said one of said holes and with the latter opening into said tube, the bottom end of the tube being adapted for a press fit with said dip tube.

4. The nozzle of claim 1 in which the other of said holes and which does not have said means, is provided with an extension conduit that extends backwardly from the cavity's said back wall to a position more adjacent to the inside of said skirt on the latter's side opposite to said cavity.

5. The nozzle of claim 1 in which said skirt is cylindrical and the outside of the insert's said front wall projects radially at least slightly from the skirt's outside so as to form a valve seat and said body is encircled by a rotative cylindrical sleeve having a radial opening, the inside of this sleeve seating on said valve seat and closing said orifice when the sleeve is in one rotative position and when this sleeve is in a second rotative position its said opening registering with the insert's said front wall and opening said discharge orifice.

6. The nozzle of claim 5 in which said sleeve internally has a pad that seats on the insert's front wall for closing said orifice.

7. The nozzle of claim 5 in which said sleeve is part of a cap covering said body and the sleeve has an internal annular groove, said body having an external flange snap-fitted in said groove to retain said cap and its sleeve rotatively on the body.

* * * * *

UNITED STATES PATENT AND TRADEMARK OFFICE

Certificate

Patent No. 4,157,789 Patented June 12, 1979

Robert H. Laauwe

Application having been made by Robert H. Laauwe, the inventor named in the patent above identified, and Essex Chemical Corp., Clifton, N.J., a Corp. of N.J., the assignee, for the issuance of a certificate under the provisions of Title 35, Section 256, of the United States Code, adding the name of Stanley L. Roggenburg, Jr. as a joint inventor, and a showing and proof of facts satisfying the requirements of the said section having been submitted, it is this 19th day of April 1983, certified that the name of the said Stanley L. Roggenburg, Jr. is hereby added to the said patent as a joint inventor with the said Robert H. Laauwe.

Fred W. Sherling,
*Associate Solicitor*